United States Patent [19]

Marold

[11] 4,137,738

[45] Feb. 6, 1979

[54] TIME LOCK WITH AUTOMATIC RESET

[75] Inventor: Ulrich Marold, Hinterzarten, Fed. Rep. of Germany

[73] Assignee: Theodor Kromer KG Spezialfabrik für Sicherheitsschlösser, Freiburg i.Br., Fed. Rep. of Germany

[21] Appl. No.: 819,891

[22] Filed: Jul. 28, 1977

[30] Foreign Application Priority Data

Jul. 29, 1976 [DE] Fed. Rep. of Germany ..... 2634107

[51] Int. Cl.[2] ..... E05B 43/00

[52] U.S. Cl. ..... 70/274

[58] Field of Search ..... 70/274, 272, 273, 267–271

[56] References Cited

U.S. PATENT DOCUMENTS

| | | | |
|---|---|---|---|
| 211,995 | 2/1879 | Hall | 70/272 |
| 573,855 | 12/1896 | Blake | 70/273 |
| 1,632,429 | 6/1927 | Benham et al. | 70/273 |
| 1,722,071 | 7/1929 | Benham | 70/273 |
| 4,062,210 | 12/1977 | Uyeda | 70/272 X |

*Primary Examiner*—Roy D. Frazier
*Assistant Examiner*—William E. Lyddane
*Attorney, Agent, or Firm*—Michael J. Striker

[57] ABSTRACT

A time lock usable with a lock mechanism having a bolt displaceable along a path for opening a door has a housing which is fixed adjacent the path and in which a keeper is vertically displaceable between an uppermost blocking position, a lowermost unblocking position, and an intermediate position. A clockwork in the housing displaces a lock slide horizontally from a holding position wherein a recess in this lock slide is out of alignment with a dog pivoted in the housing into a freeing position with the recess and dog aligned after elapse of a predetermined interval of time. This locking dog is carried on a locking pawl which is connected via a shortenable link to the vertically displaceable keeper. When the clockwork displaces the lock slide into the freeing position the keeper automatically drops into the intermediate position, with the dog entering upwardly into the recess in the lock slide. Displacement of the lock bolt along the path pushes the keeper further downwardly so as to bend and shorten the link between the keeper and the pawl and therefore pull the dog downwardly out of the recess in the lock slide and allow the device to be reset without having to reposition this pawl.

24 Claims, 15 Drawing Figures

TIME LOCK WITH AUTOMATIC RESET

BACKGROUND OF THE INVENTION

The present invention relates to a time lock. More particularly this invention concerns a time lock used in conjunction with the lock mechanism of a vault door.

A strong room or vault is provided with a door having an extensive and heavy-duty lock mechanism. A plurality of bolts can be extended outwardly into the jamb receiving the edge of the door, controlled by an actuating mechanism in turn operated by means of a key- or combination-controlled lock. The time lock itself is connected to the actuating mechanism and is provided normally inside the vault, safe or strong box. Before the door is closed the timer of such a time lock is set so that even if the proper combination or key is employed, it is impossible to open the safe or strong room door before the set interval has elapsed.

Normally such a time lock is provided in the path of a bolt or other part of the lock mechanism for the safe. Before elapsing of the set time a keeper or bolt of the time lock is positioned in the path of the lock part so that it cannot be moved in the manner necessary to open the door that is locked. Only when the set time has elapsed does this keeper withdraw and unblock the lock part so that the lock mechanism can be operated to open the door.

Normally such a device has a pair of lock members, one of which is formed with a recess and the other of which is formed as a pawl engageable in this recess and connected to the keeper that can block the path of the bolt of the lock mechanism. When the set time has elapsed the recess is aligned by a clockwork of the time lock with the pawl so that this pawl can drop into the recess and allow the keeper to move out of the way of the bolt of the lock mechanism. The lock member with the pawl is normally slidable by the clockwork into a position with its recess aligned with the above-mentioned pawl.

It is normally essential to minimize the resistance that the lock member offers to the clockwork, so that the clockwork can be made as sensitive as possible and it therefore need not push against a relatively heavy mass. When, however, the lock member is made too light, it is possible for a skilled safe cracker to actuate the mechanism by jarring the time lock from the side so as to slide this lock member in the necessary direction to align its recess with the pawl. Thus it is necessary to provide a relatively heavy biasing spring preventing such unauthorized use, so that the clockwork or clockworks must operate against a relatively heavy force.

Another disadvantage of the known systems is that it is necessary not only to wind up the clockworks of the time lock before closing the safe or strong room, but it is also necessary to set the time lock. Such setting normally consists in displacing by means of a lever or knob the lock member having the recess into a position with its recess out of line with the pawl, simultaneously pulling the pawl out of this recess. Thus a frequent occurrence is that the time lock is not properly set, a condition which cannot be detected once the safe is closed, thereby almost completely eliminating the effectiveness of this type of arrangement.

SUMMARY OF THE INVENTION

It is therefore an object of the present invention to provide an improved time lock.

Another object is to provide such a time lock which is easy to service and adjust, yet which can be produced at relatively low cost.

A further object is the provision of a time lock wherein setting of the lock merely requires setting of the clockworks, so that inadvertent partial actuation of the time lock is ruled out.

Yet another object is to provide such a time lock which cannot be opened as described above by jarring it from the side.

A final object is the provision of a time lock which, in the event of a person accidentally being locked inside a strong room having such a time lock, can easily be operated by such person so that he or she can readily exit.

These objects are attained according to the present invention in a time lock of the above-described general type wherein the keeper or bolt is connected by means of a shortenable link to the pawl. This link is set up so that it displaces the bolt out of the blocking position preventing operation of the lock part into a position freeing this lock part, and for simultaneous displacement of the pawl from a position engaged in the recess of the other lock member into a position disengaged from this other lock member when the above-mentioned lock part is moved along the path through the lock mechanism.

This is achieved in accordance with the present invention by making the keeper vertically displaceable between an uppermost or blocking position, an intermediate position partially blocking the path for the lock part, and a lower position completely unblocking this path. When the clockwork of the time lock operates the keeper at the end of the elapsed time it merely displaces it from the blocking to the intermediate position. Thereafter displacement of the lock part along its path displaces this keeper from the intermediate to the unblocking position, simultaneously displacing the pawl from the engaged to the disengaged position. Thus no two-stage actuation of the time lock is necessary. The user need merely wind it up before shutting the safe or strong box, and need not separately set or arm the time lock. Such winding of the clockwork automatically pulls a small pusher on the clockwork away from the lock member so that a relatively weak biasing spring can displace this lock member back into the holding position in which its recess is not aligned with the pawl.

According to further features of this invention the keeper is vertically displaceable across the path of the lock part, and lies higher in the blocking than in the unblocking position. The pawl is pivotal on the housing about a horizontal pivot axis and has one arm extending in one direction horizontally and radially from this axis which is connected via the link to the keeper, and another arm extending horizontally and radially in the opposite direction and formed as a dog engageable in the recess of the lock member. Thus the weight of the bolt serves to pivotally push this side of the pawl down, thereby pushing the other side of the pawl up so that the dog is urged by the weight of the keeper toward the lock member so that when this lock member is moved into the freeing position this dog can slip upwardly into the downwardly open recess of the lock member.

In accordance with yet another feature of this invention the keeper is movable through an intermediate position in which it only partially blocks the path of the lock part. In this intermediate position it can be depressed by the lock part downwardly. The link is of shortenable effective length and means is provided in the lock for shortening the effective length of the link when the keeper is moved from the intermediate into the unblocking position.

According to yet another feature of this invention spring means is provided for normally urging the link into the position of maximum length, normally extending straight up and down between a pivot on the keeper and a pivot on the pawl. Thus after displacement of the lock part through the housing so as to depress the keeper from the intermediate to the unblocking position and thereby moving the pawl into the disengaged position, and after setting of the clockwork to move the lock member into the holding position, withdrawal of the lock part will cause the keeper to spring fully up into the blocking position automatically. Such a sequence of events occurs on closing the door carrying such a time lock, as a standard procedure is to wind and set the clockwork or clockworks, and then to close the door and operate the lock mechanism from outside, which action withdraws the lock part from the time lock.

According to yet another feature of this invention the lock member is a horizontally displaceable slide, and is normally biased by means of a relatively weak spring into the holding position. In order to prevent unauthorized operation of the time lock by jarring it from the side, another slide or counterweight is provided in the housing which is slidable horizontally parallel to the lock member. A linkage pivoted on the housing is provided for automatically displacing the counterweight in a direction exactly opposite the direction of displacement of the lock member. Such a linkage may be formed as a simple two-arm lever pivoted on the housing and having one end connected to the slidable locking member and another end engageable with the slidable counterweight. Thus a jar in one or the other horizontal direction will be completely cancelled out by the counterweight and prevent unauthorized opening of the lock. Such an arrangement allows a very weak biasing spring to be employed on the slidable lock member so that the clockwork or clockworks need not overcome a considerable force to operate the time lock.

The link described above may be formed of a pair of link sections, namely a lower section pivoted on the pawl and an upper section pivoted on the lower section and on the keeper. In the blocking and intermediate positions the pivot axes at the upper and lower ends of the link as well as at the center of the link are vertically aligned for good force transmission down from the keeper to the pawl. The upper section is provided with a bent-over end that coacts with a cam on the housing once the lock has been displaced into the intermediate position to pivot the center of the link inwardly into a bent link position and thereby shorten the effective length of the link. Such a shortening automatically pulls the pawl into the disengaged position in which its dog, although still aligned with the recess of the lock member, is completely free of this recess and positioned so that the lock member can easily be withdrawn into the holding position.

According to yet another feature of this invention the housing is formed of a back part having a guide for a bolt constituting the lock part of the lock mechanism of the door on which this time lock is being used, and a sealed front part housing the clockwork and the lock member and carrying the pawl which extends through the rear part of this front part and is engageable with the link. To this end the pawl is formed at its rear end as a fork. Screws serve as holding means for securing the front part to the rear part. With such an arrangement it is therefore possible to remove the entire front part of the assembly which contains much of the mechanism of the time lock and, indeed, any of the sensitive parts thereof which might need occasional servicing or work. The simple and virtually failure-free keeper and back plate can remain secured to the door in a position properly aligned with the slidable bolts constituting the lock part.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 1:
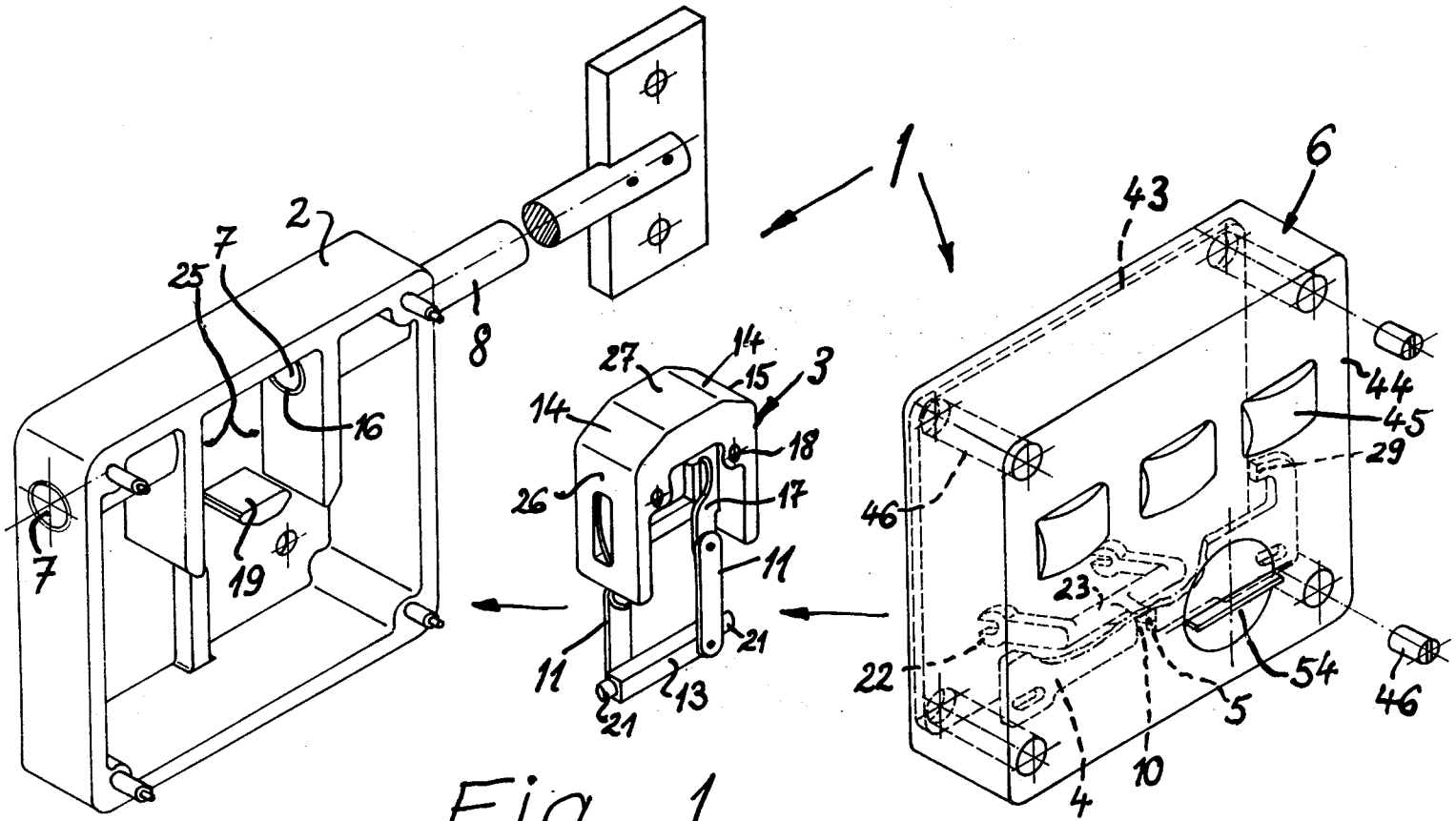
FIG. 1 is an exploded view of the time lock according to this invention.
Figure 3:
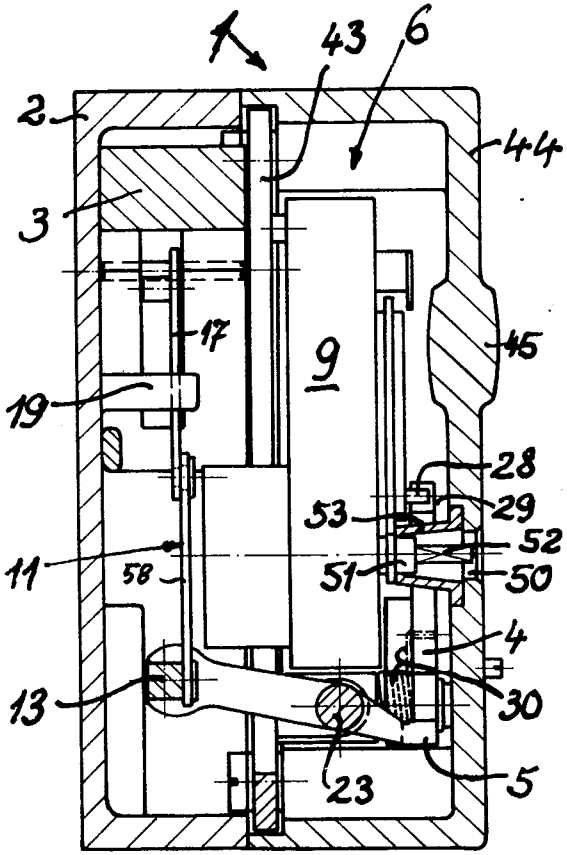
FIG. 3 is a section taken along line III—III of FIG. 2.

As shown in FIG. 1 a time lock 1 according to this invention basically comprises a rear housing part 2 and a front housing part 6. A lock member 4, here a horizontally displaceable slide, is provided in the front part 6, and a vertically displaceable weight or keeper block 3 is vertically displaceable and guided in the rear part 2. A so-called locking dog 5 is vertically pivotal into engagement in a downwardly open recess 10 formed in the lock slide 4 and is connected via a pair of bendable links 11 to the weight 3.

Figure 2:
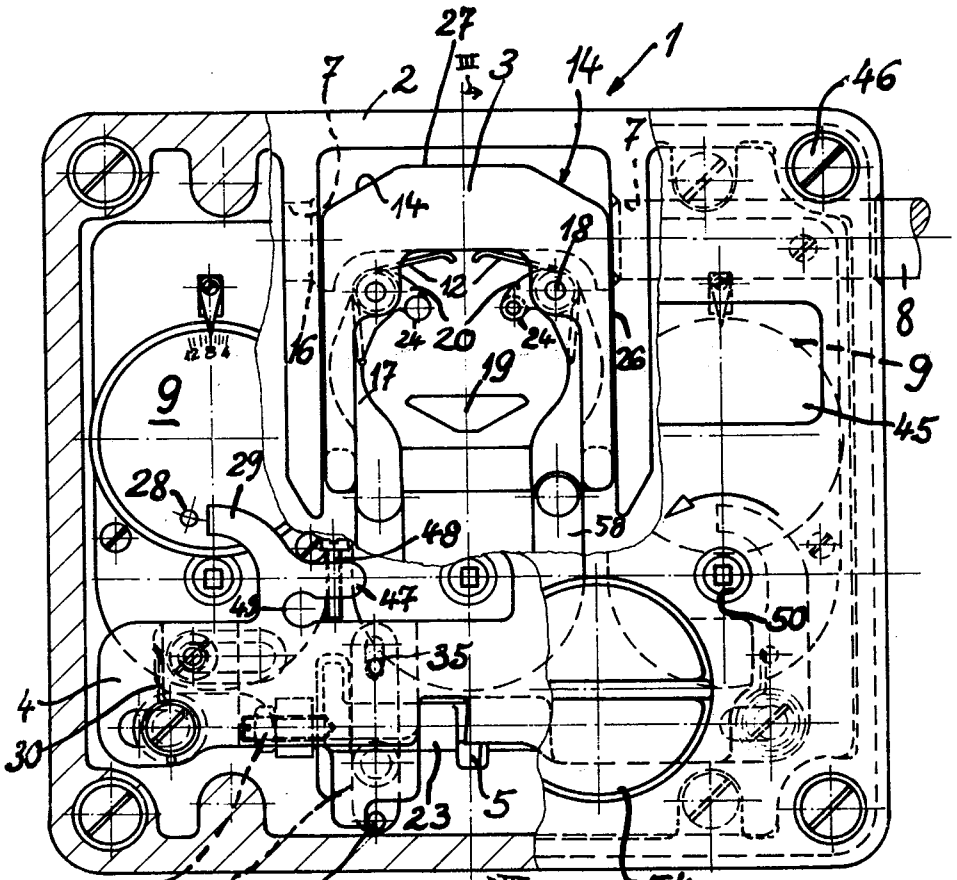
FIG. 2 is a partly broken away and sectional front view of the lock shown in FIG. 1, with the keeper in the blocking position, the pawl in the engaged position, and the lock member in the holding position.

A bolt 8 constituting part of a locking mechanism and defining a central axis is horizontally displaceable through a cylindrical passage 7 extending all the way through the rear part 2 of the housing that is normally fixedly bolted to the back of the door of a large safe or strong room. The front part 6 houses, as shown in FIG. 2, three clockworks 9 which serve to horizontally displace the slide 4 against the force of a relatively weak spring 30 to the right as shown in FIG. 1.

As also shown in FIGS. 2–9 each of the links 11 is constituted by a lower link section 58 pivoted at its lower end on a square-section rod 13 and an upper link section 17 pivoted at 18 on the keeper 3. The links 11 are oppositely bendable at their middles toward each other and are normally biased into the straight position shown in FIG. 4 by a torsion spring 12 having one arm bearing on the bottom of the keeper 3 and another arm bearing on the inside of the respective leg 17. Both of the links 11 are pivoted at their lower ends of their lower sections 58 on the square-section rod 13 whose ends 21 are of cylindrical shape. Furthermore each of the upper link sections 17 is uniformly formed with a hook or bent over end portion 20 carrying on its free end a roller 24 engageable with a fixed abutment or cam 19 formed on the housing back part 2.

The keeper 3 has an upper end surface 27 parallel to the path defined by the passage 7, and a pair of sides 26 guided on respective guide surfaces 25 formed on the back housing part 2. At each of the corners between each side 26 and the end 27 there is a bevelled corner 14 having a lower edge 15 which lies in the intermediate position shown in FIG. 4 slightly below the lower edge 16 of the passage 7.

Figure 4:
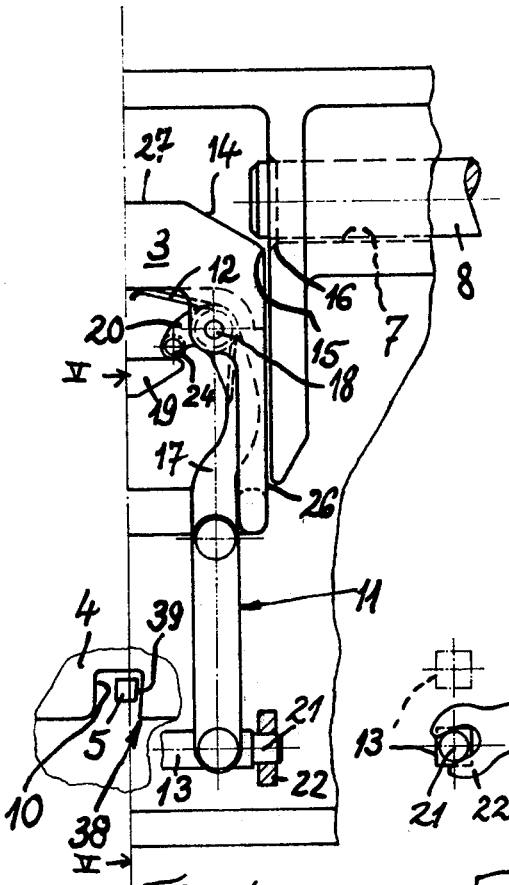
FIG. 4 is a detail view similar to FIG. 2 showing the bolt in the intermediate position, the lock member in the freeing position, and the pawl in the engaged position.
Figure 5:
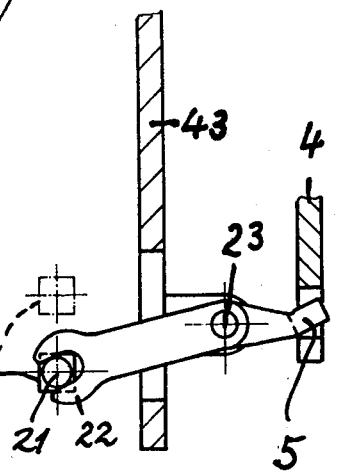
FIG. 5 is a vertical section taken along line V—V of FIG. 4 showing a detail thereof.
Figure 6:
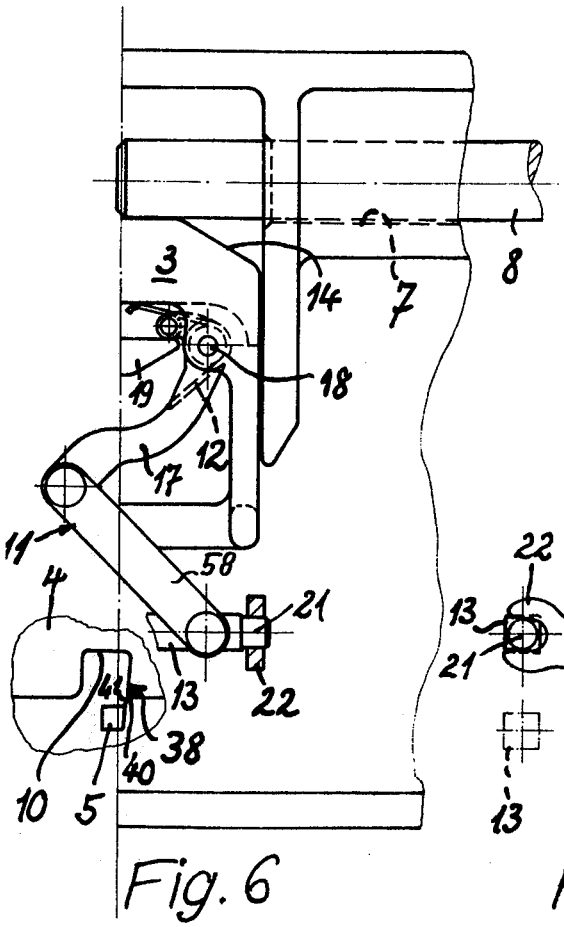
FIGS. 6 and 7 are views similar to FIGS. 4 and 5, respectively, but showing the bolt in the unblocking position and the pawl ready to engage in the recess of the lock member.
Figure 7:
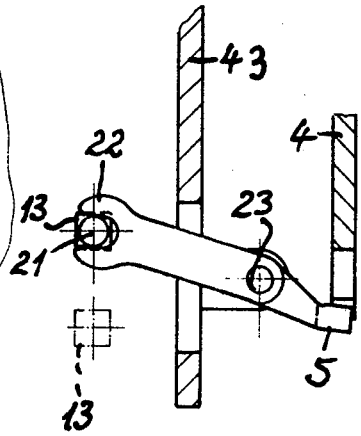

In the intermediate position shown in FIG. 4 the rollers 24 just contact the fixed cam 19. Passage of the lock part or bolt 8 through the passage 7 past the keeper 3 in either direction will bring the end of this bolt 8 in contact with the bevelled corner 14 and force the keeper 3 downwardly. Such further downward displacement will push the rollers 24 against the cam 19 and pivot the upper link sections 17 inwardly so that, even though the keeper 3 and upper link section 17 are moving downwardly, the lower link 58 will be displaced upwardly. This will raise the rod 13.

The front housing part 6 is formed by a front casing 44 and a back plate 43. A pivot 23 extending horizontally and parallel to the direction of displacement of the lock slide 4 carries a fork 22 whose ends engage over the rounded ends 21 of the square-section link rod 13. Also carried on and jointly pivotal with this fork 22 is the pawl 5. FIG. 2 further shows how adjustment screws 42 provided with respective lock nuts are provided in the pivots on the plate 43 for horizontally adjusting the fork 22, and thereby horizontally positioning the dog 5 relative to the slide 4.

Figure 10:
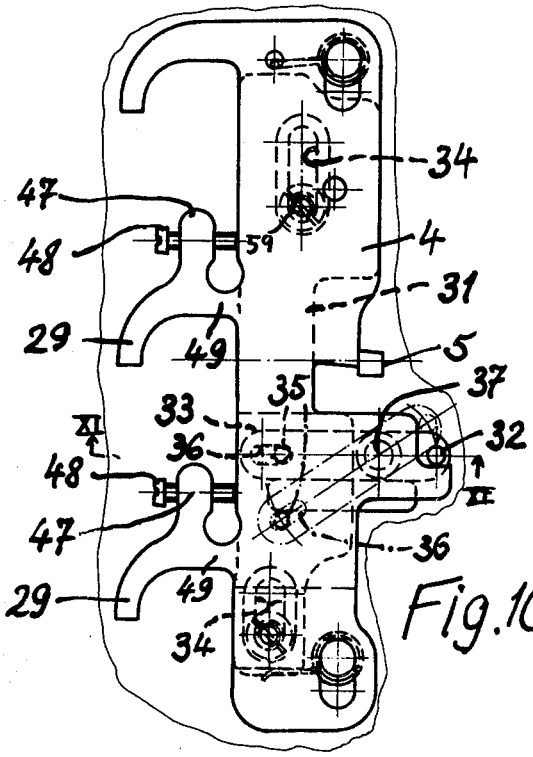
FIG. 10 is a side view mainly showing the lock member according to this invention.
Figure 15:
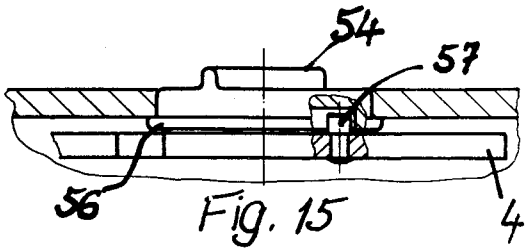
FIGS. 14 and 15 are views similar to FIGS. 12 and 13, respectively, but showing the structure thereof in a different position.
Figure 14:
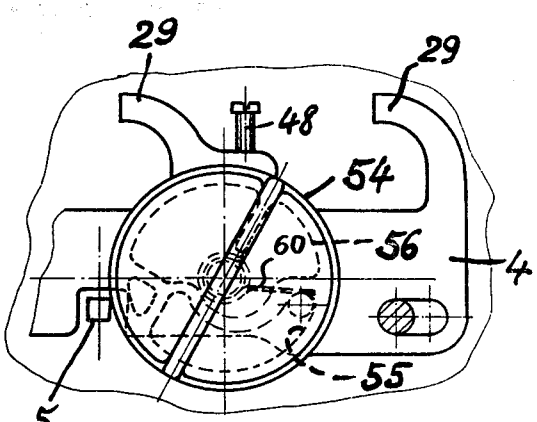
Figure 13:
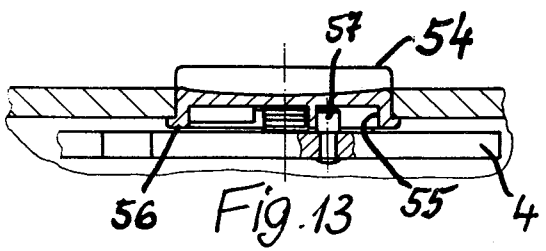
FIG. 13 is a section taken along line XIII—XIII of FIG. 12.
Figure 12:
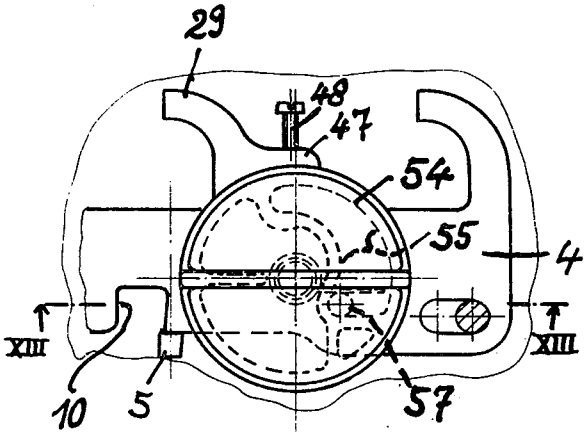
FIG. 12 is a front view of a detail of the time lock according to this invention.

The lock slide has three upwardly extending arms or projections 29 each of which engages a respective pin 28 (FIG. 3) of a respective clockwork 9. Two of these arms 29 are formed as shown in FIG. 10 with weakened regions 49 and lateral extensions 47. Screws threaded into the extensions 47 bear against the body of the slide 4 so that these arms 29 can be deformed somewhat. The screws 48 are adjusted so that at one time all of the ends of the arms 29 exactly abut their respective pusher pins 28 of the respective clockworks 9.

In order further to increase the exactness with which the above-described arrangement functions the recess 10 and the dog 5 have corresponding and parallel engageable surfaces 38 and 39 which extend at an angle to the displacement direction of the slide 4 and which have corners 40 and 41 directed at each other. Thus as soon as the corners 40 and 41 pass each other the dog 5 will drop into the recess 10, causing the keeper 3 to drop from the blocking position of FIGS. 2 and 3 to the intermediate position of FIG. 4.

Figure 8:
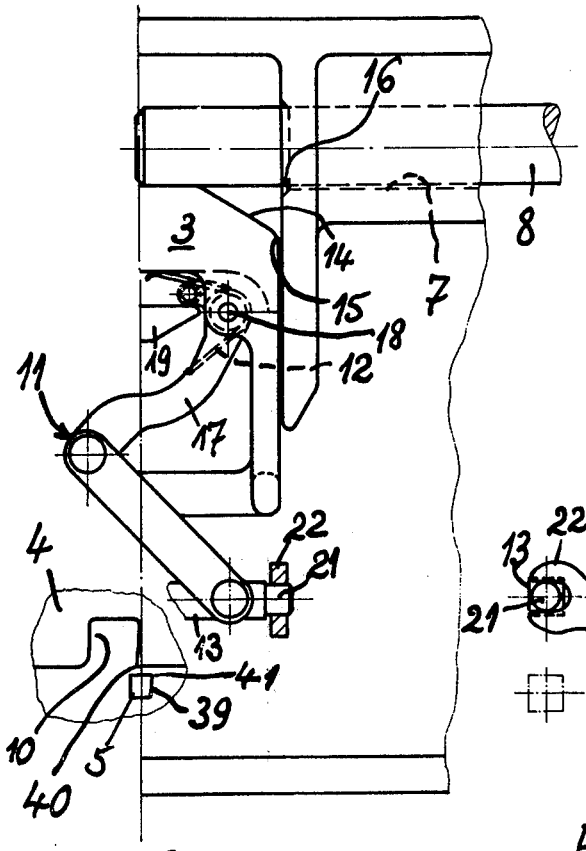
FIGS. 8 and 9 are views similar to FIGS. 6 and 7, respectively, but showing the pawl once again in its engaged position and the lock member in the holding position.
Figure 9:
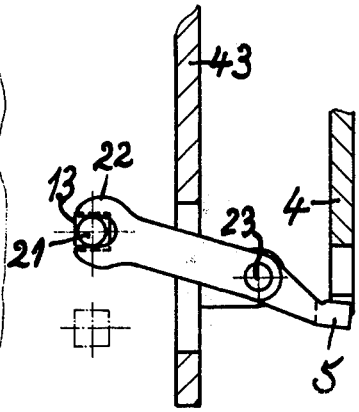
Figure 11:
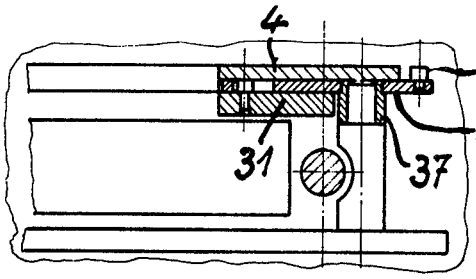
FIG. 11 is a section taken along line XI—XI of FIG. 10.

Once this intermediate position, as described above, displacement of the bolt 8 through the lock will push the keeper 3 down into the unblocking position and simultaneously pivot the pawl 5 down until it is once again pulled out of the recess 10. Rewinding of the clockworks 9 while the arrangement is in this position will cause the slide 4 to move back as shown in FIG. 8 so that when the bolt is withdrawn the dog 5 will come to rest against the bottom of the slide 4 and the springs 12 will push this keeper 3 up into the blocking position again.

In order to prevent unauthorized operation of the time lock 1 in the known manner by simply jarring it on one side so as to momentarily push the slide 4 over against the force of the springs 30, a counterweight 31 is provided on the back of the slide 4. To this end the slide 4 is provided with pins 59 that engage in slots 34 formed in the weight 31. A straight lever 33 is pivoted at 37 on the plate 43 of the front part 6 and has one end formed with an elongated slot 36 in which engages a pin 35 fixed in the slide 4. At its other end the lever 33 carries a pin 32 engaged against a portion of the slide 4. Thus this lever 33 constitutes a linkage which automatically displaces the weight 31 in a direction opposite the displacement of the slide 4. The springs 30 urge both of these members toward the left as shown in FIG. 2, that is urging the slide 4 into the holding position. Thus if the lock housing is given a jar tending inertially to urge the slide 4 toward the right and into the freeing position the counterweight 31 will similarly be urged toward the right and will exert a force identical and opposite on the slide 4 toward the left, thereby completely cancelling out such force. To this end the weight 31 is of the same mass as the slide 4. Such an arrangement allows very weak springs 30 to be used to bias the slide 4 into the holding position so that the clockworks 9 can operate with utmost precision.

The front housing part 6 is sealed together, with the back plate 43 soldered or adhesively secured in place. The entire front part 44 may be formed of a transparent synthetic-resin material such as polymethylmethacrylate, or may only have transparent windows 45 aligned with the dials on the clockworks 9. Screws 46 secure the front part 6 to the rear part 2. Thus this entire front assembly housed between the plate 43 and the case 44 and containing the three clockworks 9, the slide 4, the counterweight 31 and the various holding structure and springs therefor can be removed as a single unit. The forks 22 project backwardly through the plate 43 and are readily separable from the rod 13. Thus all of the delicate parts of the structure are tightly encased.

This hermetic sealing is even aided by the fact that the three winding holes 50 of the structure, each aligned with a respective winding shaft 51 having a square-section extension 52, are provided with a sealing cuff 53. Thus even during winding of the arrangement the front part remains sealed and entry of dust or moisture into the delicate mechanism is avoided.

The front part 6 is also provided with a knob 54 shown in detail in FIGS. 10–14 and provided on its rear surface with a disk 56 formed with an arcuate groove or camming formation 55. A pin 57 projects frontally from the slide 4, and torque spring 60 is engaged between the pin 57 and the disk 56 to urge the knob 54 into the normal rest position shown in FIG. 12 where the pin 57 can move with the slide 4 relative to the knob 54. Clockwise rotation of this knob 54 will, however, cam the pin 57 and the slide 4 toward the right, thereby moving the slide 4 into the freeing position. Thus if a person is inadvertently locked inside the strong room provided with the time lock according to this invention he or she need merely rotate the knob 54 so as to cut out the time lock, whereupon the actuating mechanism for the lock can be operated to displace the bolt 8 across the time lock 1. The time lock, therefore, does not prevent the safe or strong room from being opened from inside in case of an emergency. What is more the time lock will automatically be reset as soon as the safe is again locked from outside, as release of the knob 54 will return it to the rest position of FIG. 12 due to the spring 60 and the system will automatically reset itself as described above.

The time lock according to the present invention is therefore an extremely easy-to-use and durable assembly. It not only boasts extreme simplicity of operation, but is relatively easy to service and adjust.

It will be understood that each of the elements described above, or two or more together, may also find a useful application in other types of mechanisms differing from the types described above.

While the invention has been illustrated and described as embodied in a time lock, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A time lock usable with a lock mechanism having a lock part retractable in a path for unlocking a door or the like, said time lock comprising:

a housing fixed adjacent the path;

a locking member having a recess and displaceable in said housing between a holding position and a freeing position;

means including a clockwork in said housing for displacing said locking member from said holding into said freeing position;

a locking pawl in said housing movable between an engaged position engaged in said recess and a disengaged position clear of said recess;

a keeper mounted in said housing for travel across the path between a blocking position preventing retraction of the lock part in the path and an unblocking position permitting such retraction; and means for linking said keeper and said pawl for travel of said keeper out of said blocking position on displacement of said locking member into said freeing position and for movement of said locking pawl from said engaged into said disengaged position on retraction of the lock part in the path, said linking means having a variable effective length which is lesser in said unblocking than in said blocking position of said keeper.

2. The time lock defined in claim 1, wherein said keeper is a vertically displaceable weight and lies higher in said blocking position than in said unblocking position.

3. The time lock defined in claim 1; further comprising spring means for urging said linking means into a position of maximum length.

4. The time lock defined in claim 3, wherein said linking means includes a linking element which is deformable from a straight position corresponding to said blocked position to a bent position corresponding to said unblocked position, said spring said spring means urging said link into said straight position.

5. The time lock defined in claim 4, wherein said keeper travels between said blocking and unblocking positions through an intermediate position partially blocking said path and said linking means moves said pawl from said engaged position into said disengaged position on travel of said keeper from said intermediate position into said unblocking position by the lock part.

6. The time lock defined in claim 5; further comprising means for deforming said linking element from said straight into said bent position on travel of said keeper from said intermediate into said unblocking position.

7. The time lock defined in claim 5, wherein said linking element has a lower section pivoted on said pawl and an upper section having one end pivoted on said keeper and another end pivoted on said lower section, said upper section having a bent-over end; and wherein said deforming means includes cam means on said end and engageable with said housing in said intermediate position of said keeper.

8. The time lock defined in claim 1, wherein said pawl is pivotal on said housing about a generally horizontal pivot axis and has to one side of said axis an end provided with a dog engageable in said recess and on the other side of said axis an end connected via said linking means to said keeper, said lock member being slidable generally parallel to said axis between said freeing and holding positions.

9. The time lock defined in claim 8, wherein said keeper is vertically slidable between said blocking and unblocking positions, said dog being higher in said engaged than in said disengaged position.

10. The time lock defined in claim 9, wherein said keeper is displaceable through an intermediate position partially blocking said path and vertically between said blocking and unblocking positions.

11. The time lock defined in claim 10, wherein said keeper has a beveled edge extending at an acute angle to the path engageable cammingly by the lock part in said intermediate position.

12. The time lock defined in claim 10, wherein said linking means includes a linking element having a variable effective length and deformable between a straight position of maximum length and a bent position of lesser length.

13. The time lock defined in claim 12; further comprising spring means urging said linking element into said straight position.

14. The time lock defined in claim 13; further comprising cam means in said housing engageable with said linking element in said intermediate position of said keeper for displacing said linking element from said straight to said bent position on displacement of said keeper from said intermediate to said unblocking position and thereby pulling said dog out of said recess.

15. The time lock defined in claim 8, said displacing means includes at least one additional clockwork; and wherein said locking member has a plurality of projections each operatively engageable in a direction parallel to said axis with a respective one of said clockworks, at least one of said projections being deflectable in said direction relative to the other projection for adjustment of said time lock.

16. The time lock defined in claim 8; further comprising a counterweight displaceable in said housing parallel to said locking member, and means including a linkage positively interconnecting said locking member and said counterweight for displacing said counterweight oppositely to said locking member on displacement of said lock member in said housing.

17. The time lock defined in claim 16, wherein said counterweight is of generally the same mass as said locking member.

18. The time lock defined in claim 17, wherein said linkage is a lever pivoted on said housing at a lever axis and having to one side thereof an arm engageable with said counterweight and on the other side thereof an arm engageable with said locking member.

19. The time lock defined in claim 8; further comprising means on said housing for displacing said locking member independently of said clockwork into said freeing position.

20. The time lock defined in claim 19, wherein said means is a knob rotatable on said housing and formed with a camming formation operatively engageable with said locking member.

21. The time lock defined in claim 8, wherein said housing includes a back part formed with a guide for said keeper and for the lock part and a sealed box-like front part containing said clockwork and said locking member and carrying said pawl, said pawl projecting backwardly from said front part into said back part, said lock further comprising means for securing said back part and said front part together.

22. The time lock defined in claim 8, wherein said clockwork has a winding shaft, said housing having a front plate formed with a throughgoing hole aligned with said winding shaft and provided with a cuff sealingly engaged between said clockwork and said hole while leaving said shaft exposed.

23. The time lock defined in claim 8, wherein said locking member is displaceable in a predetermined direction in said housing, said recess and said dog being formed with mutually engageable parallel surfaces extending at an angle to said direction.

24. The time lock defined in claim 8, wherein said dog is upwardly engageable into said recess and the weight of said keeper normally urges said dog upwardly.

* * * * *